US007222557B2

(12) United States Patent
Li et al.

(10) Patent No.: US 7,222,557 B2
(45) Date of Patent: May 29, 2007

(54) RATCHETING TOOL DRIVER

(75) Inventors: Peng Li, Ellicott City, MD (US); Zhihong Fu, Shanghai (CN); Kean-Tuan Tan, Addison, TX (US); John Michael Underbrink, Richardson, TX (US)

(73) Assignee: Easco Hand Tools, Inc., Simsbury, CT (US)

( * ) Notice: Subject to any disclaimer, the term of this patent is extended or adjusted under 35 U.S.C. 154(b) by 0 days.

(21) Appl. No.: 11/231,655

(22) Filed: Sep. 21, 2005

(65) Prior Publication Data

US 2007/0062340 A1 Mar. 22, 2007

(51) Int. Cl.
*B25B 13/46* (2006.01)
*B25B 13/00* (2006.01)

(52) U.S. Cl. ..... 81/63.1; 81/62

(58) Field of Classification Search ..... 81/62, 81/63.1; 192/43.1, 43.2
See application file for complete search history.

(56) References Cited

U.S. PATENT DOCUMENTS

| | | | | |
|---|---|---|---|---|
| 791,895 | A | 6/1905 | Purbish | |
| 1,493,353 | A | 5/1924 | Leopold | |
| 2,627,330 | A | 2/1953 | Gantz | |
| 2,720,296 | A | 10/1955 | Briglia | 192/43.1 |
| 3,342,229 | A | 9/1967 | Janes | 145/71 |
| 3,356,117 | A | 12/1967 | Wagner | 145/71 |
| 3,783,703 | A | 1/1974 | Trimble et al. | 74/157 |
| 4,290,328 | A | 9/1981 | Clark | 81/62 |
| 4,735,120 | A | 4/1988 | Beugelsdyk | 81/63.1 |
| 5,437,212 | A | 8/1995 | Thompson et al. | 81/63.1 |
| 5,520,073 | A | 5/1996 | Bakula et al. | 81/63.1 |
| 5,535,648 | A | 7/1996 | Braun et al. | 81/63.1 |
| 5,570,616 | A | 11/1996 | Thompson et al. | 81/63.1 |
| 5,575,192 | A | 11/1996 | Eggert | 81/63.1 |
| 5,685,204 | A | 11/1997 | Braun | 81/63.1 |
| 5,687,820 | A | 11/1997 | Lin | 81/63.1 |
| 5,711,193 | A | 1/1998 | Eggert et al. | 81/63.1 |
| 5,974,915 | A | 11/1999 | Chou | 81/63.1 |
| 5,988,337 | A | 11/1999 | Liu | 192/43.1 |
| 6,047,802 | A | 4/2000 | Huang | 192/43.2 |
| 6,227,077 | B1 | 5/2001 | Chiang | 81/63.1 |
| 6,250,183 | B1 | 6/2001 | Chiang | 81/63.2 |
| 6,370,988 | B1 | 4/2002 | Thompson et al. | 81/63.1 |
| 6,450,312 | B1 * | 9/2002 | Hsiao | 192/43.2 |
| 6,644,147 | B1 | 11/2003 | Huang | 81/62 |
| 7,028,587 | B1 * | 4/2006 | Chiang | 81/63.1 |
| 2004/0154439 | A1 * | 8/2004 | Tuan-Mu | 81/58.4 |

FOREIGN PATENT DOCUMENTS

| | | |
|---|---|---|
| DE | 9208547 | 10/1992 |
| DE | 9318291 | 4/1994 |
| GB | 2145359 | 3/1985 |

* cited by examiner

*Primary Examiner*—David B. Thomas
(74) *Attorney, Agent, or Firm*—Nelson Mullins Riley & Scarborough, L.L.P.

(57) ABSTRACT

A ratcheting tool driver has a handle and a ratcheting body that includes a plurality of recesses for receiving a plurality of pawls having teeth formed thereon. A cover is axially secured to the ratcheting body and rotates relative to the body over a limited distance. The cover is formed so that it interacts with the plurality of pawls, which are operatively received in the body recesses so that they engage and disengage teeth formed on a socket ring. The socket ring contains a plurality of teeth on its outer circumference, is received in an axial bore formed in the ratcheting body, and operatively engages the pawl teeth.

13 Claims, 14 Drawing Sheets

RATCHETING TOOL DRIVER

BACKGROUND OF THE INVENTION

The present invention relates to drivers for interchangeable driver bits and, in particular, to drivers of the ratcheting type.

Ratcheting drivers are well known, as are drivers with interchangeable bits. Conventional ratchet mechanisms for ratcheting screwdrivers, for example, have pawls that extend in the axial direction (defined by the screwdriver shaft) and that have narrow extensions engageable with teeth of a gear provided on the shaft. The pawls are pushed into and out of engagement with the gear by a control member that is usually slidable in the axial direction. Such ratchet mechanisms occupy a significant proportion of the overall length of the screwdriver.

One type of ratcheting driver for interchangeable bits is disclosed in U.S. Pat. No. 4,777,852. This patent discloses a ratcheting arrangement wherein a ratchet body is press-fitted into a recess in one end of a handle and a cap telescopes over the body for rotation with respect thereto. The force transmission from the cap to the pawl assembly is indirect and involves a multi-part assembly.

SUMMARY OF THE INVENTION

The present invention recognizes and addresses considerations of prior art constructions and methods. In an embodiment of the present invention a ratcheting tool driver comprises a hand-actuatable body having a first axial bore, an end face transverse to said first axial bore, a first chamber recessed from and opening into said end face and said first axial bore and a second chamber recessed from and opening into said end face and said first axial bore, said second chamber being located on an opposite side of said first axial bore from said first chamber. A socket ring disposed in, and rotatable about an axis of, the first axial bore, the socket ring defining teeth about an outer circumference thereof and defining a second axial bore that receives a tool shank in rotational driving engagement therein. A first pawl having at least one pawl tooth is disposed in the first chamber so that the first pawl is slidable transversely to the first axial bore between a first pawl first position in which the at least one first pawl tooth engages the socket ring teeth so that the first pawl blocks relative rotation between the body and the socket ring in a first rotational direction, and a first pawl second position in which the at least one first pawl tooth is disengaged from the socket ring teeth. A second pawl having at least one pawl tooth is disposed in the second chamber so that the second pawl is slidable transversely to the first axial bore between a second pawl first position in which the at least one second pawl tooth engages the socket ring teeth so that the second pawl blocks relative rotation between the body and the socket ring in a second rotational direction opposite the first rotational direction, and a second pawl second position in which the at least one second pawl tooth is disengaged from the socket ring teeth.

A cover is rotatably received on the hand-actuatable body and comprises an end wall defining a bore therethrough and a generally cylindrical side wall coupled to the end wall that defines a first ramped cam area and a second ramped cam area, the first and second ramped cam areas defining a plurality of cavities therein such that an end of the first and the second pawls engage the respective ramped first and second cam areas. The cover is disposed on the body so that the cover is rotatable about the body between a first position in which the first cam area engages the first pawl so that the first pawl is in the first pawl first position, and the second cam area engages the second pawl so that the second pawl is in the second pawl first position, a second position in which the first cam area engages the first pawl so that the first pawl is in the first pawl first position, and the second cam area engages the second pawl so that the second pawl is in the second pawl second position, and a third position in which the first cam area engages the first pawl so that the first pawl is in the first pawl second position, and the second cam area engages the second pawl so that the second pawl is in the second pawl first position.

A metal clip is received in the first and second cam areas and is shaped to abut the walls of the plurality of cavities formed in each cam area such that an end of the first and the second pawls engage the metal clip within respective ramped first and second cam areas.

A first spring is disposed between a wall of said first recessed chamber and said first pawl so that said first spring biases said first pawl at least one pawl tooth towards said socket ring teeth. Additionally, a second spring is disposed between a wall of said second recessed chamber and said second pawl so that said second spring biases said second pawl at least one pawl tooth towards said socket ring teeth.

The cover is secured to the hand-actuatable body by a snap ring received in a first annular groove formed in an outer circumference of said body and a second annular groove formed in the cover side wall inner circumference.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
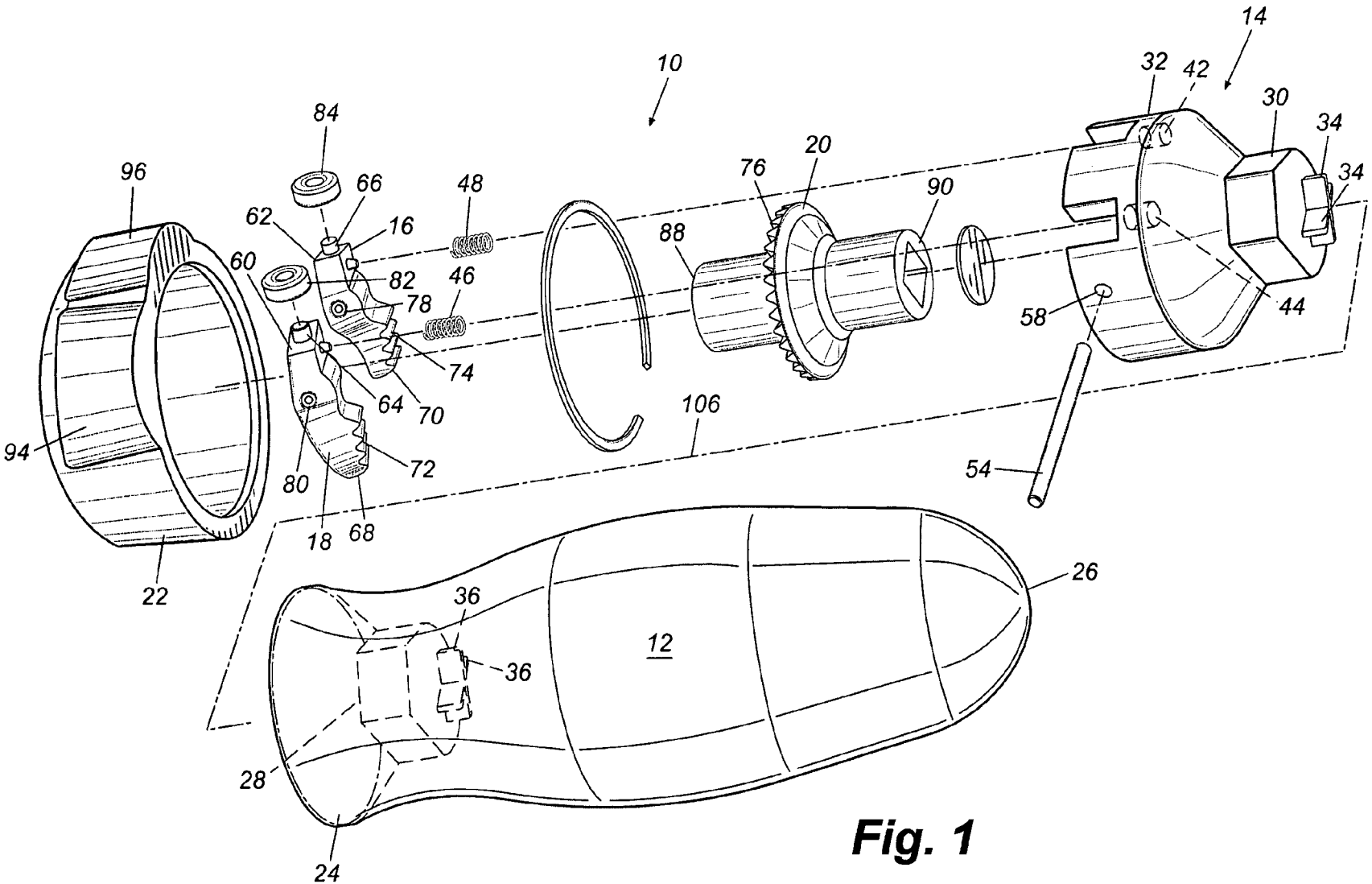
FIG. 1 is an exploded view of a ratcheting tool in accordance with an embodiment of the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

FIG. 1 shows a ratcheting driver, in this instance a screwdriver, 10 in accordance with an embodiment of the present invention. Driver 10 includes a handle 12, a body 14, pawls 16 and 18, a socket ring 20, and a cover 22. Handle 12 is generally cylindrical in shape and includes a first end 24 and a second end 26. The exterior shape of handle 12 may vary as desired, and the handle may be formed from any suitable material including, but not limited to, wood, metal or metal alloy, ceramic, rubber or a polymer. Handle 12 may be knurled and/or may include a polymer or rubber coating around its periphery to increase the effectiveness of a user's grasp. Handle 12 may also include polymer inserts at angular positions of the handle to provide gripping portions for the user to securely grip the handle and apply adequate torque on a work piece. First end 24 defines an axial bore 28 of a size and shape to receive body 14, as further described below.

Body 14 comprises a shaped shank portion 30 and a generally cylindrical ratcheting body 32. Shaped shank portion 30 may be, for example cylindrical, octagonal, pentagonal, triangular, square, or any other polygonal shape or other shape that rotationally secures the body and the handle, and in one preferred embodiment, shaped shank portion 30 is hexagonal and contains one or more ribs or splines 34 on an end thereof that are received in respective corresponding grooves 36 formed in recess 28. Splines 34, grooves 36 and recess 28 together rotationally lock handle 12 to body 14. Other methods may be implemented to rotationally lock handle 12 to body 14. For example, body 14 may be press fit into handle 12, or shank portion 30 may contain axial splines (not shown) that mate with corresponding axial grooves (not shown) formed on the inner diameter of bore 28 to thereby rotationally lock handle 12 to body 14. Additionally, adhesive may also be used intermediate handle 12 and shank portion 30 to fixedly secure the handle to the body portion. In another embodiment of the body 14 shown in FIGS. 2B–5B, shaped shank portion 30 is generally cylindrical in shape and has opposite flat sides 31 that are received in corresponding flats in bore 28. The handle and the shaped shank portion can be press-fitted together or adhesive may be used to axially retain the handle to the shank portion.

Figure 2A:
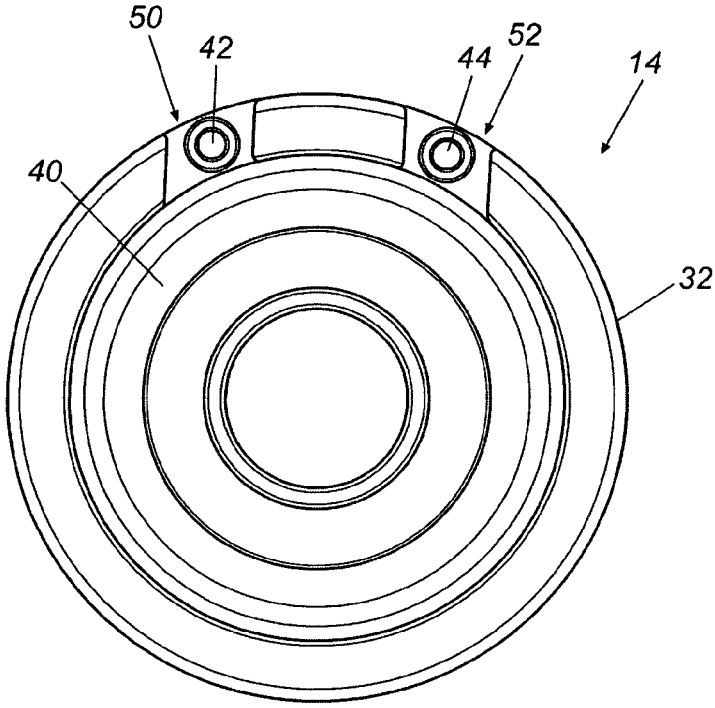
FIG. 2A is a top view of a ratcheting body in accordance with an embodiment of the present invention.
Figure 2B:
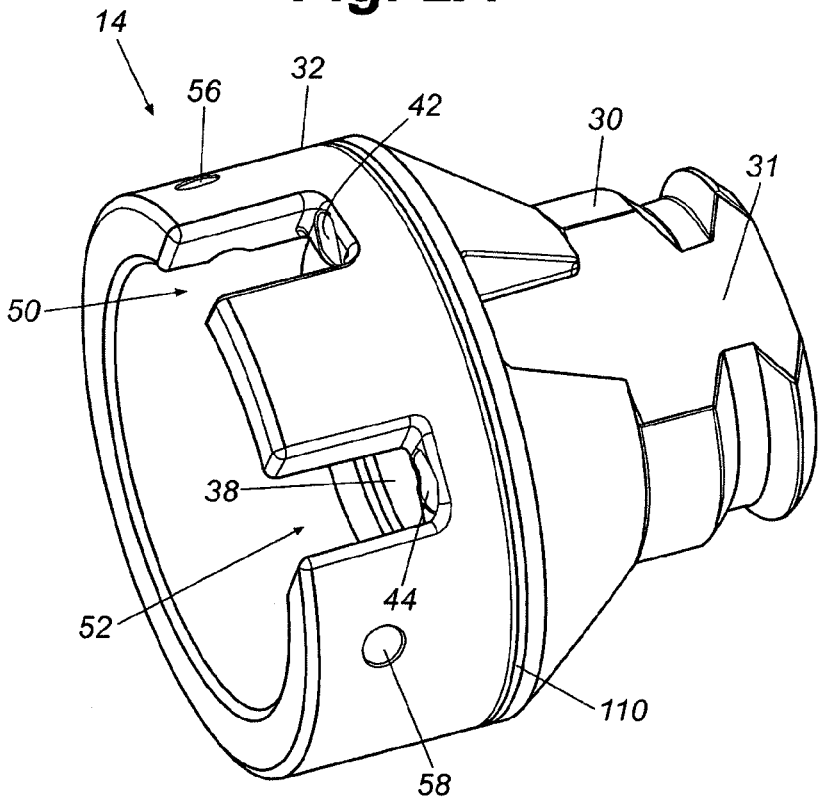
FIG. 2B is a perspective view of the ratcheting body as in FIG. 2A.
Figure 3A:
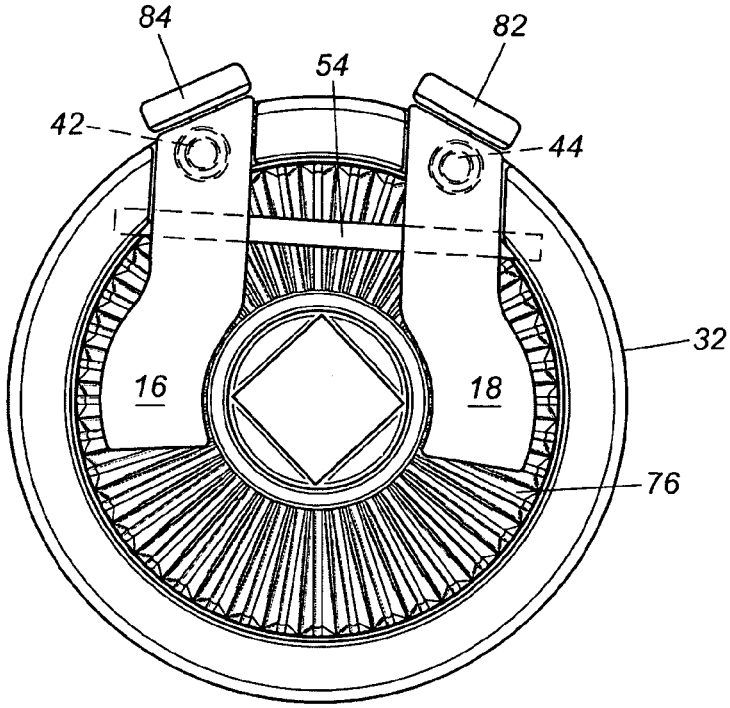
FIG. 3A is a top view of the ratcheting body as in FIG. 2A, including a ratchet ring and pawls.
Figure 3B:
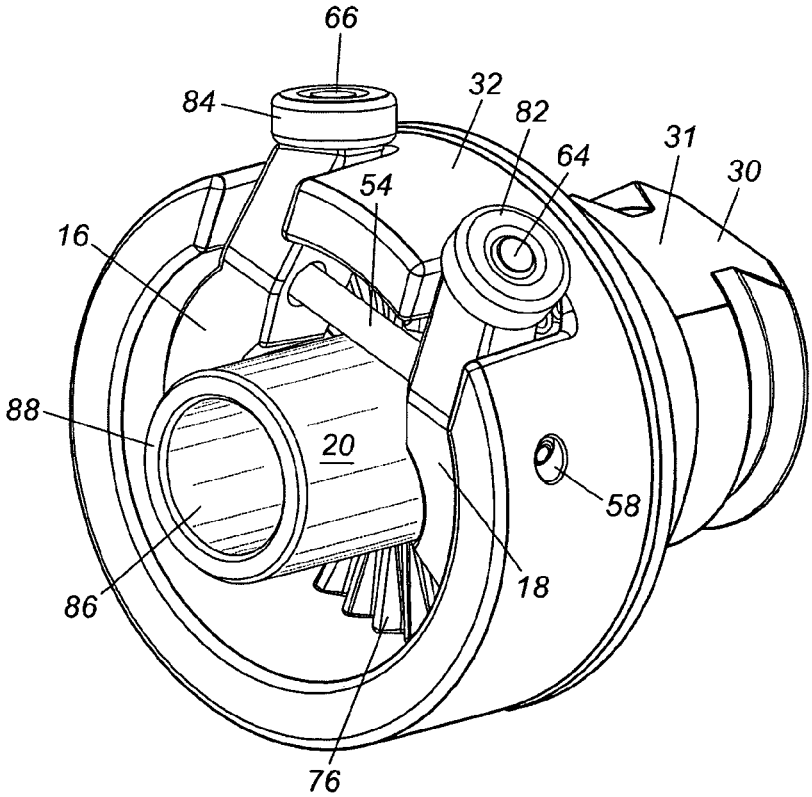
FIG. 3B is a perspective view of the ratcheting body as in FIG. 3A.

Body 14 may be formed from any suitable material such as stainless steel, alloys or other metals and, in a preferred embodiment, is formed from zinc alloy. Shank portion 30 and generally cylindrical ratcheting body 32 define an axial bore 38 (FIG. 2A) adapted to receive socket ring 20. Referring to FIGS. 2A and 2B, a front face 40 of generally cylindrical ratcheting body 32 also defines two blind axial bores 42 and 44 that receive respective sets of springs 46 and 48 (FIG. 1). Other detent means may be used instead of a spring, for example spring/pin set, a spring-loaded lever or ball, a clip spring, a nylon spring, or a self contained spring and plunger unit.

Referring to FIGS. 2A–5B, generally cylindrical ratcheting body 32 defines two recessed openings 50 and 52 through its outer circumference that are recessed from and open into ratcheting body front face 40 and that receive portion of pawls 16 and 18, respectively. Pawls 16 and 18 are rotatably mounted on a pin 54 (FIGS. 3A and 3B) that is received and fixed in two holes 56 and 58 (FIGS. 2B and 3B). Because recessed openings 50 and 52 open into front face 40, pawls 16 and 18 may be placed into the ratcheting body during the driver's manufacture through the open front face.

Returning again to FIG. 1, pawls 16 and 18 are generally rectangular but may be formed in any suitable shape. Pawl ends 60 and 62 define pins 64 and 66, and pawl ends 68 and 70 define respective sets of teeth 72 and 74 that interact with socket ring teeth 76 formed on socket ring 20. Teeth 72 and 74 may be defined on an arc having a radius so that at least some of the teeth on the pawls engage with the teeth on the socket ring, or in the embodiment shown in FIG. 1, the teeth are generally defined over a linear surface so that most of the teeth on the pawl engage the teeth on the socket ring. The sides of pawl ends 68 and 70 proximate the socket ring bore 86 are curved to provide clearance around the socket ring. The curvature allows teeth 72 and 74 to align with socket ring teeth 76.

Still referring to FIG. 1, bores 78 and 80 formed in pawls 16 and 18, respectively, receive pin 54 so that the pawls are rotationally fixed about the pin in a manner that allows pawl ends 68 and 70 to be biased toward socket ring 20. Each of pins 64 and 66 receive respective wheels 82 and 84. Wheels 82 and 84 engage cover 22 during the operation of driver 10, as explained in detail below.

Socket ring 20 is generally cylindrical in shape with an axial bore 86 (FIG. 3B) formed in one end. Axial bore 86 is circular in cross-section at a first end 88 and polygonal in cross-section at a second end 90 (FIG. 1) to receive a polygonal-shaped tool shaft. It should be understood that axial bore 86 may be configured in any suitable shape, for example in an oval, square, rectangular or TORX cross-section, to receive and rotationally lock a suitable tool shaft to socket ring 20. Socket ring teeth 76 are shaped to match pawl teeth 72 and 74. Socket ring first end 88 (FIG. 5B) extends through a hole 92 in cover 22 when the cover is secured to the generally cylindrical ratchet body 32.

The number of teeth on socket ring 20 may increase or decrease depending on the desired rotational resolution and torque loading requirements. Rotational resolution as used herein refers to the amount of angular rotation of the driver handle necessary to result in one revolution of the tool shaft. That is, a larger number of teeth on the socket ring and pawl results in a higher rotational resolution and thus a greater angular rotation of the driver handle to result in one revolution of the tool shaft. Torque loading, however, is lowered in that the increased number of teeth results in smaller teeth that are more susceptible to slippage. The opposite is true for a lower number of teeth. That is, when the number of teeth is reduced and tooth size is increased, torque loading increases since the pawl teeth are less likely to slip over the socket ring teeth. However, larger teeth result in lower resolution. Therefore, the driver's use will determine the proper balance between rotational resolution and torque loading and, in turn, the number of teeth and tooth size. Tooth size, shape and density are uniform on both the socket ring and the pawl so that the pawl teeth mesh with the socket ring teeth.

Figure 4A:
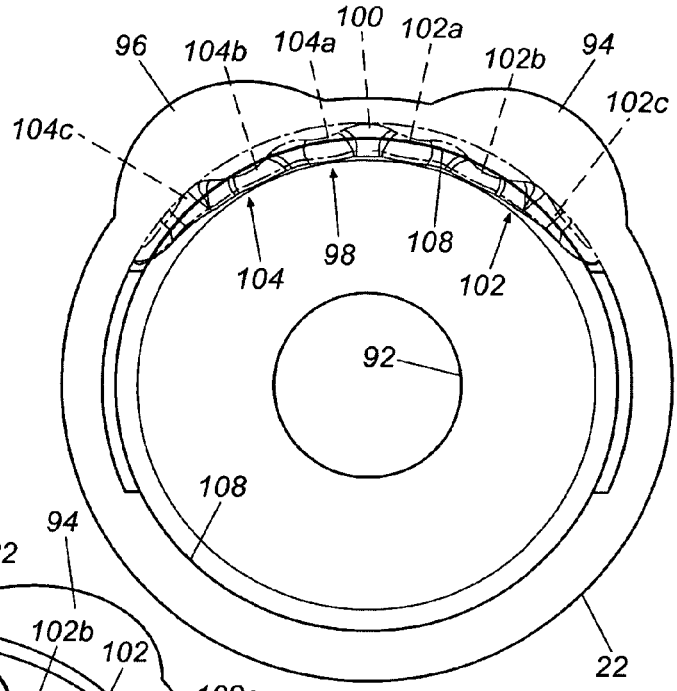
FIG. 4A is a bottom view of a cover in accordance with an embodiment of the present invention.
Figure 4B:
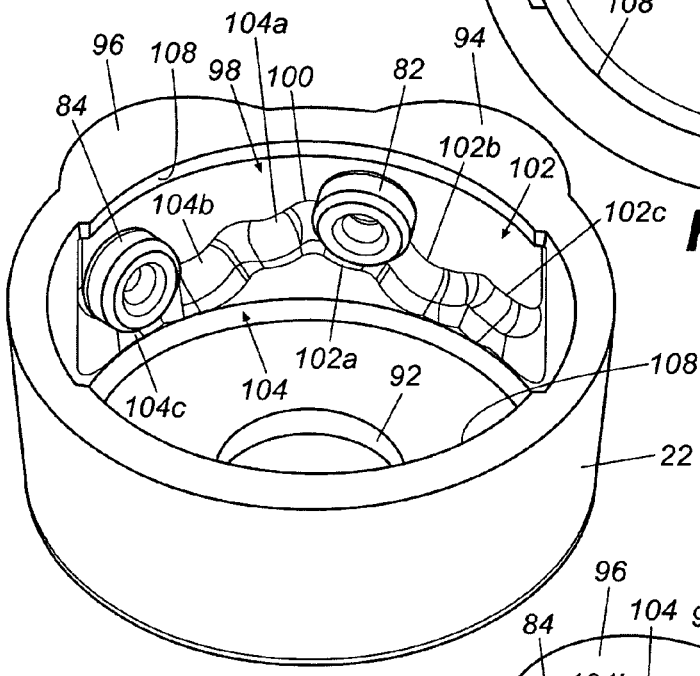
FIG. 4B is a perspective view of the cover as in FIG. 4A.
Figure 4C:
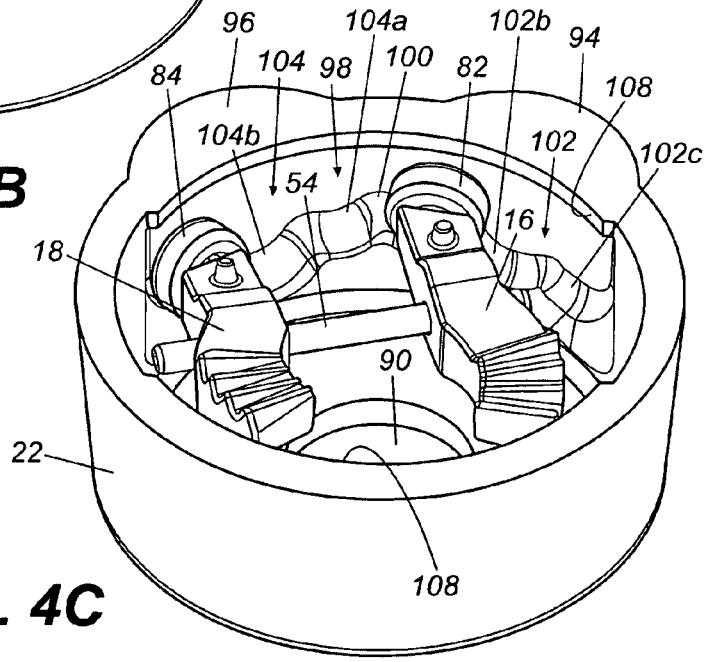
FIG. 4C is a perspective view of the cover as in FIG. 4B.
Figure 5A:
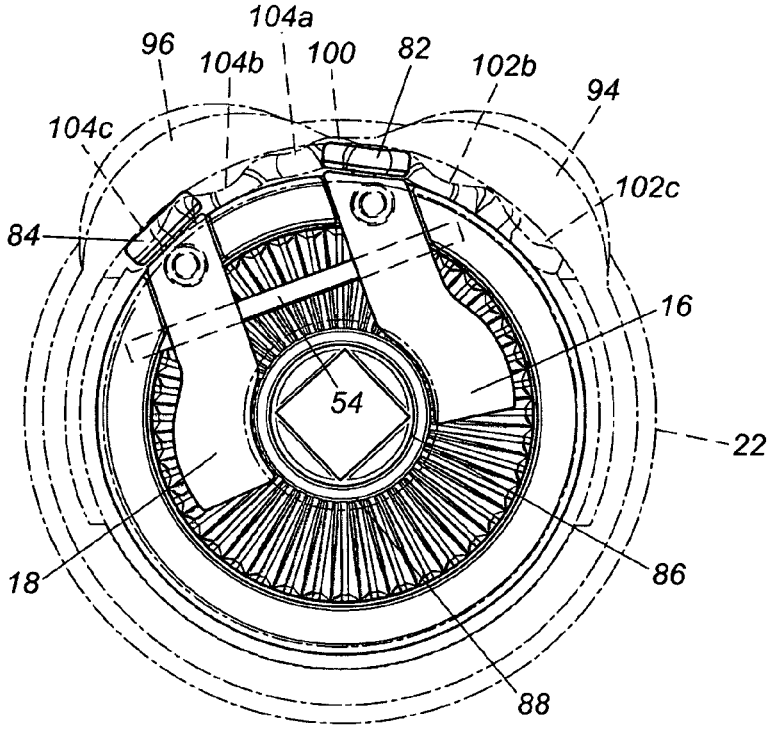
FIG. 5A is a top view of the ratcheting tool as in FIG. 1, the cover shown in phantom.
Figure 5B:
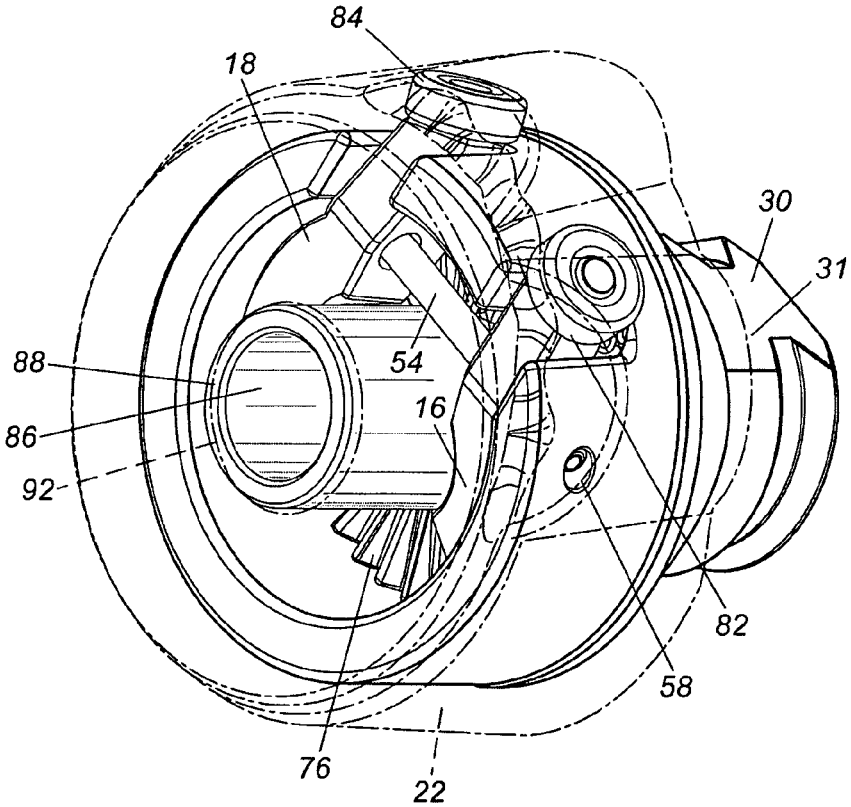
FIG. 5B is a partial perspective view of the ratcheting tool as in FIG. 1, the cover shown in phantom.

Referring to FIGS. 4A–4C, cover 22 is generally cylindrical in shape and includes two outwardly extending knurled thumb grip portions 94 and 96. A cam surface, designated generally as 98, is formed on an inner circumference of cover 22 between thumb grip portions 94 and 96. Cam surface 98 has one protruding portion 100 and two recessed portions 102 and 104. Depending on the cover's rotational position with respect to the body, cam surface 98 will bias one or both of pawls 16 and 18 out of engagement with socket ring teeth 76 through wheels 82 and 84. When wheels 82 and/or 84 are received in certain portions of respective cam recessed portions 102 and 104, springs 46 and/or 48 (FIG. 1) bias the pawl(s) so that pawl teeth 72 and/or 74 engage socket ring teeth 76. Through-hole 92 in cover 22, centered about a longitudinal axis 106 (FIG. 1), receives axial extending portion 88 of socket ring 20 (FIG. 5B).

As shown in FIGS. 4B and 4C, each recessed portion 102 and 104 respectively defines three arcuate recesses 102*a*, 102*b*, 102*c* and 104*a*, 104*b*, and 104*c* each being recessed from protruding portion 100. Specifically arcuate recesses 102*a* and 104*a* are stepped down an equal distance from portion 100 and recesses 102*b*, 102*c*, 104*b* and 104*c* are stepped down from recesses 102*a* and 104*a* an equal distance. Thus, recesses 102*b*, 102*c*, 104*b* and 104*c* are located at the same level. The arcuate recesses are adapted to receive wheels 82 and 84 and allow the cover to remain locked in a predetermined position without accidental movement. Thus, a predetermined torque applied to cover 22 is necessary to move the wheel(s) out of one arcuate recess and into an adjacent arcuate recess. The slope of the arcuate recesses and the spring rate of the springs define the amount of torque necessary to move cover 22 relative to ratcheting body 32.

Referring to FIGS. 2B to 5B, an annular flange 108 formed on the inner circumference of cover 22 (FIGS. 4A–4C) is received in a recess 110 formed on the outer circumference of ratcheting body 32 (FIG. 2B), thereby securing the cover to ratcheting body in the axial direction. A discontinuous flange, as shown in FIGS. 4A–4C, allows cover 22 to be placed on ratcheting body 32 while allowing for limited relative rotation of the two components. Other methods for attachment are conceivable. For example, a flange (not shown) can be formed on the outer circumference of ratchet body 32 and a lip (not shown) formed on an inner circumference of the cover. When the cover is pushed onto the ratcheting body, the lip deflects outward over the flange and positions itself behind the flange, thereby retaining the cover on the ratchet body. In one preferred embodiment, a snap ring (not shown) is received in opposing grooves formed in the inner circumference of cover 22 and in the outer circumference of ratchet body 32. Thus, as the cover is pressed onto the body, the snap ring deflects radially inward until the grooves align at which point the snap ring occupies a portion of each groove axially retaining the cover on the ratchet body.

Figure 6A:
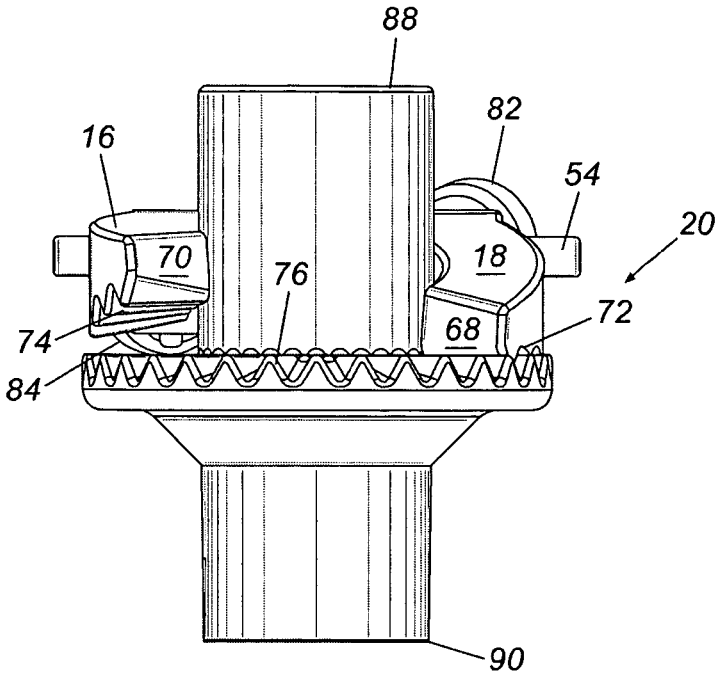
FIG. 6A is a side view of the socket ring and pawls of FIGS. 3A and 3B shown in a first position.
Figure 6B:
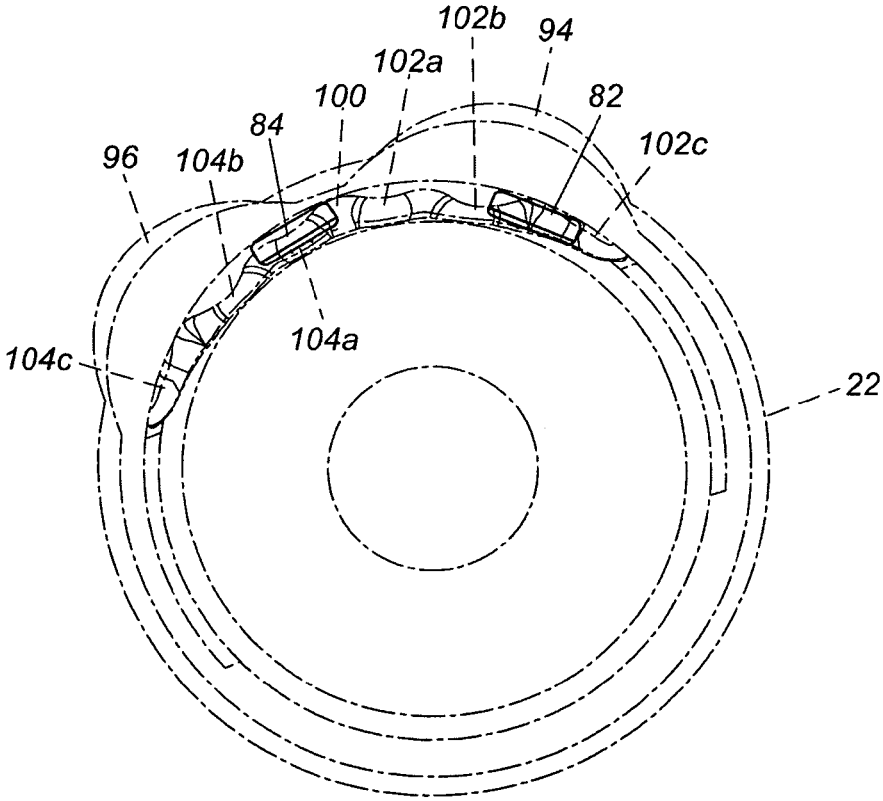
FIG. 6B is a top view of the cover of FIG. 1 shown in a position corresponding to the first position as in FIG. 6A.

In operation, and referring to FIGS. 6A–6F, driver 10 applies torque to a tool shaft when a user turns handle 12 in a first direction and/or an opposite second direction. Driver 10 may also ratchet with respect to the tool shaft in either direction, depending on the position of cover 22 with respect to body 14. FIGS. 6A and 6B respectively show socket ring 20 and cover 22 positioned so that arcuate recess 104*a* cams wheel 84 downward against the upward bias of spring 48 (FIG. 1). In this position, pawl teeth 74 are lifted away from socket ring teeth 76. Wheel 82, however, is received in arcuate recess 102*c* so that spring 46 (FIG. 1) biases pawl teeth 72 into engagement with socket ring teeth 76. Thus, when a user applies torque to handle 12 in the counterclockwise direction (from the perspective shown in FIG. 6B) while the socket ring is rotationally fixed to a work piece, socket ring teeth 76 apply a force vector to the pawl, through the pawl teeth in a direction between pin 54 and the socket ring. The pawl thus tends to pivot about pin 54 so that the teeth are driven further into engagement with the socket ring teeth. Thus, torque is applied to the work piece in the counterclockwise direction from body 14 through the pawl and the socket ring.

If, however, the user rotates handle 12 in the clockwise direction when socket ring 20 is rotationally fixed to the work piece, the reaction force between the pawl teeth and the socket ring teeth causes pawl 18 to pivot about pin 54 and push against the bias of spring 46. This compresses spring 46, and pawl teeth 72 eventually ride over socket ring teeth 76. Spring 46 then causes pawl teeth 72 to pivot back into the next set of socket ring teeth. The ratcheting process repeats as the operator continues to rotate handle 12 in the counterclockwise direction.

Figure 6C:
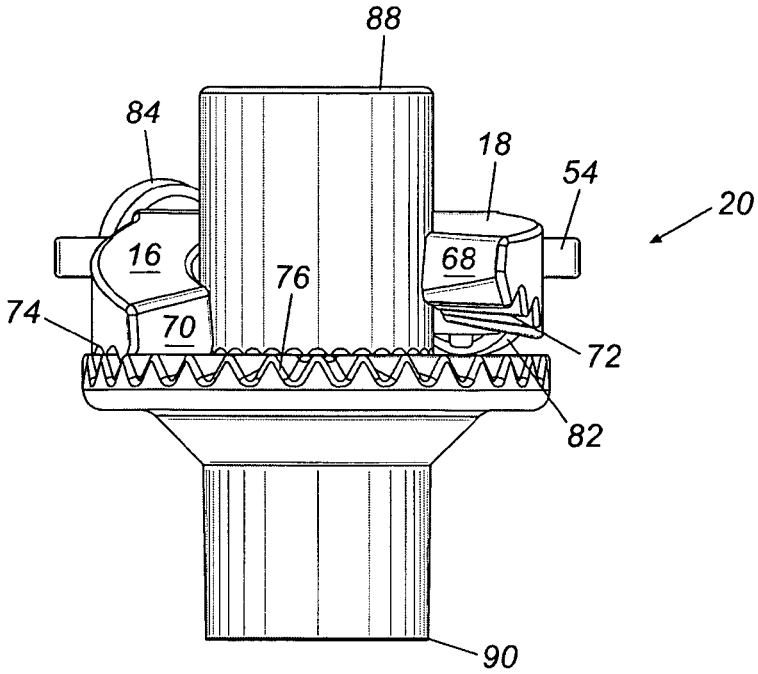
FIG. 6C is a side view of the socket ring and pawls of FIG. 6A shown in a second position.
Figure 6D:
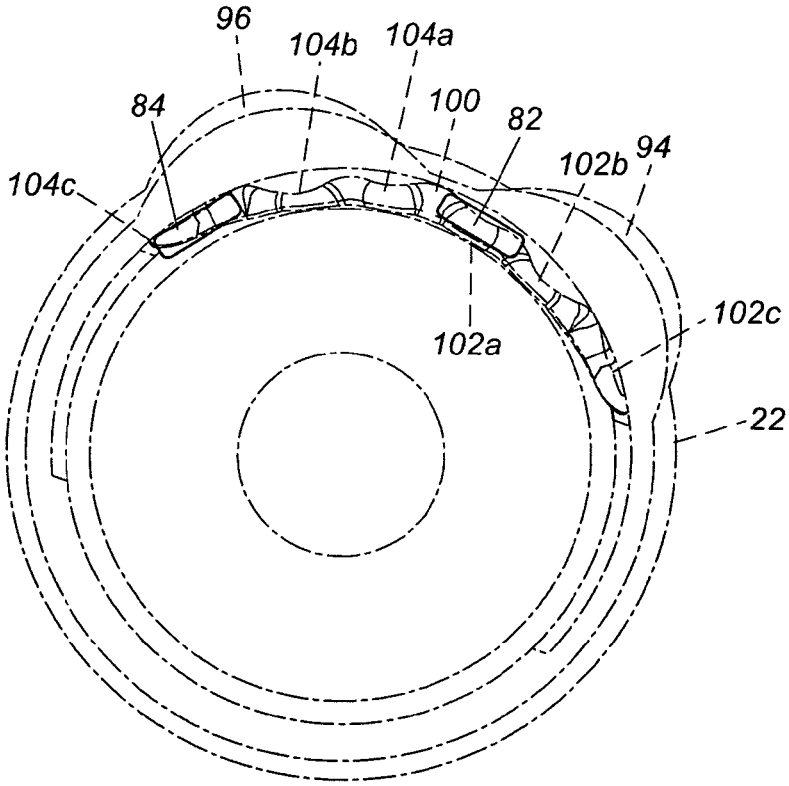
FIG. 6D is a top view of the cover of FIG. 6B shown in a position corresponding to the second position as in FIG. 6A.

FIGS. 6C and 6D show cover 22 rotated in the clockwise direction from its position in FIGS. 6A and 6B. As cover 22 is rotated, wheel 82 rides through the arcuate recesses in recessed cam portion 102 from arcuate recesses 102*c* to arcuate recess 102*a*. Likewise, wheel 84 moves from arcuate recess 104*a* to arcuate recess 104*c*. In this position, the end of pawl 18 is biased downward against the upward bias of spring 46 while pawl teeth 74 are biased into operative engagement with socket ring teeth 76. Thus, when a user applies torque to handle 12 in the clockwise direction (FIG. 6C) while socket ring 20 is rotationally fixed to a work piece, socket ring teeth 76 apply a force vector to the pawl, through the pawl teeth in a direction between pin 54 and the socket ring. The pawl thus tends to pivot about pin 54 so that the teeth are driven further into engagement with the socket ring teeth. As a result, torque is applied to the work piece in the counterclockwise direction from body 14 through the pawl and the socket ring. If, however, the user rotates handle 12 in the clockwise direction, and socket ring 20 is rotationally fixed to the work piece, the force vector against pawl teeth 74 causes pawl 16 to pivot about pin 54 against the bias of spring 48. This compresses spring 48, and pawl teeth 74 eventually ride over socket ring teeth 76. Spring 48 once again biases the pawl end upward, thereby forcing pawl teeth 74 back into the next set of socket ring teeth. This ratcheting process repeats as the operator continues to rotate handle 12 in the clockwise direction.

Figure 6E:
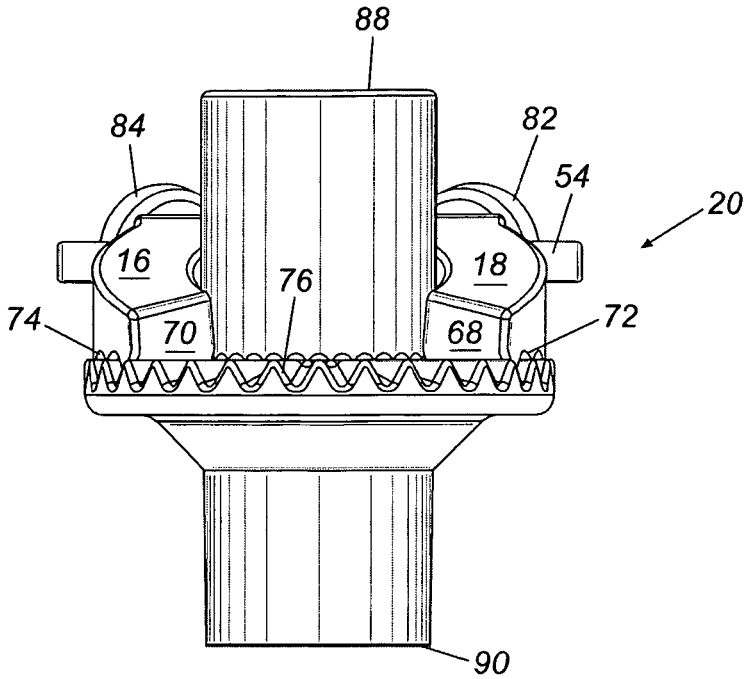
FIG. 6E is a side view of the socket ring and pawls of FIG. 6A shown in a third position.
Figure 6F:
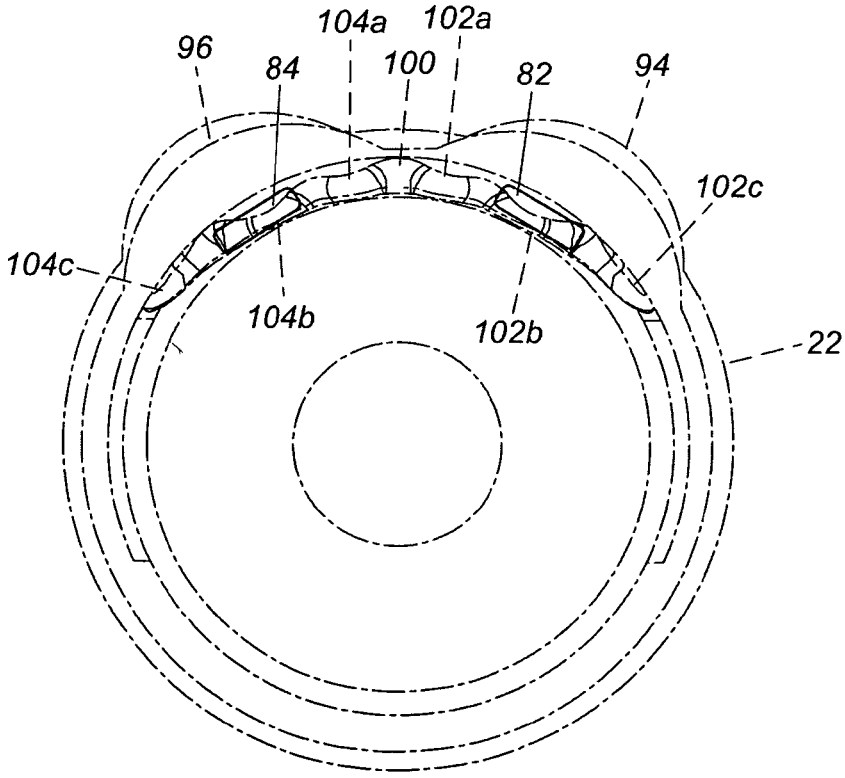
FIG. 6F is a top view of the cover of FIG. 6B shown in a position corresponding to the third position as in FIG. 6E.

Finally, referring to FIGS. 6E and 6F, cover 22 is shown rotated to a position where wheels 82 and 84 are received in arcuate recesses 104*b* and 102*b*, respectively. In this configuration, springs 46 and 48 bias the pawl ends upward causing both sets of pawl teeth 74 and 72 to engage socket ring teeth 76. Consequently, socket ring 20 is rotationally fixed to handle 12 in both the clockwise and counterclockwise directions, and driver 10 applies torque to the work piece in both directions, similarly to a conventional screwdriver.

Figure 7:
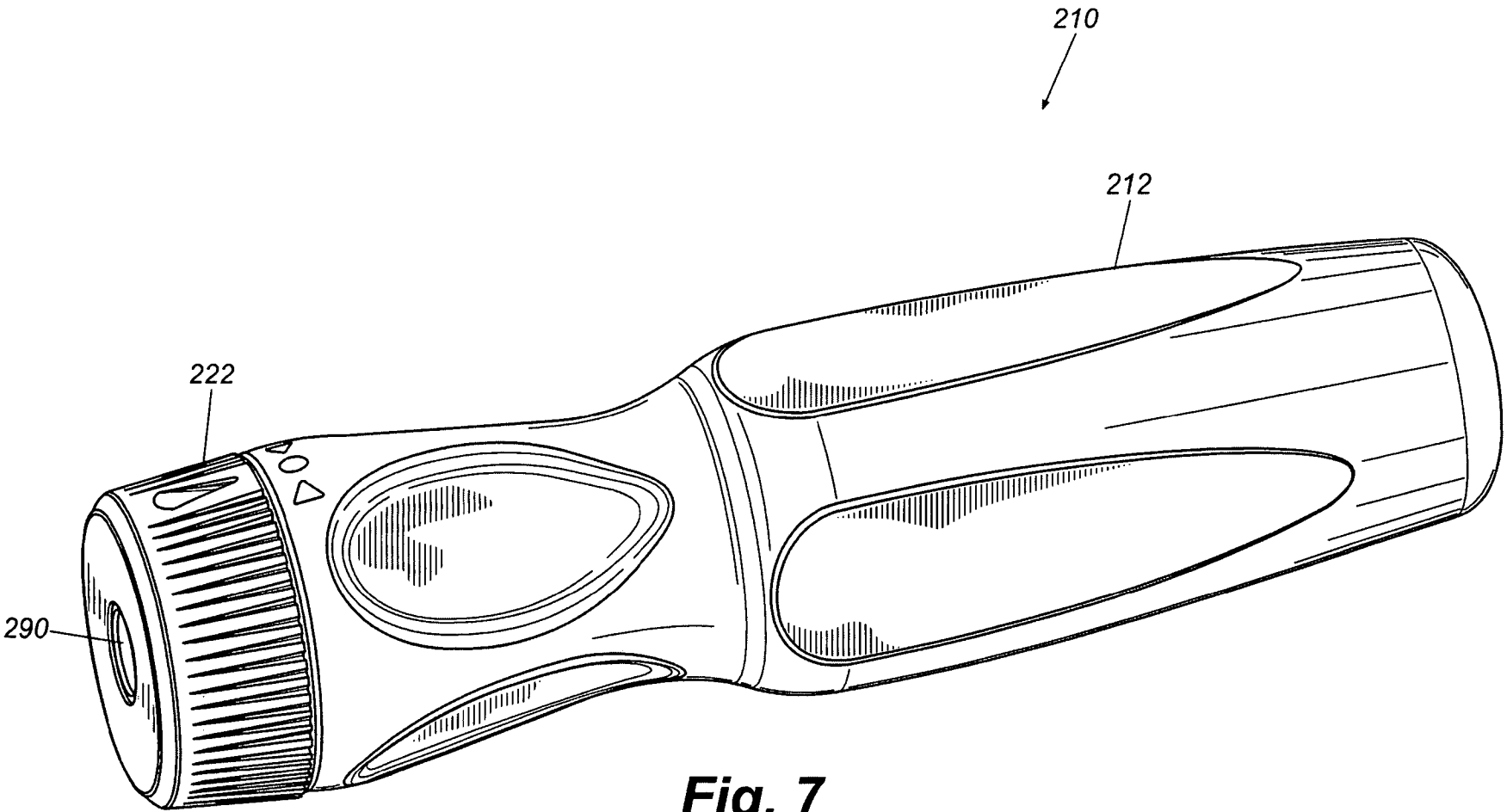
FIG. 7 is a perspective view of a ratcheting tool in accordance with an embodiment of the present invention.
Figure 8:
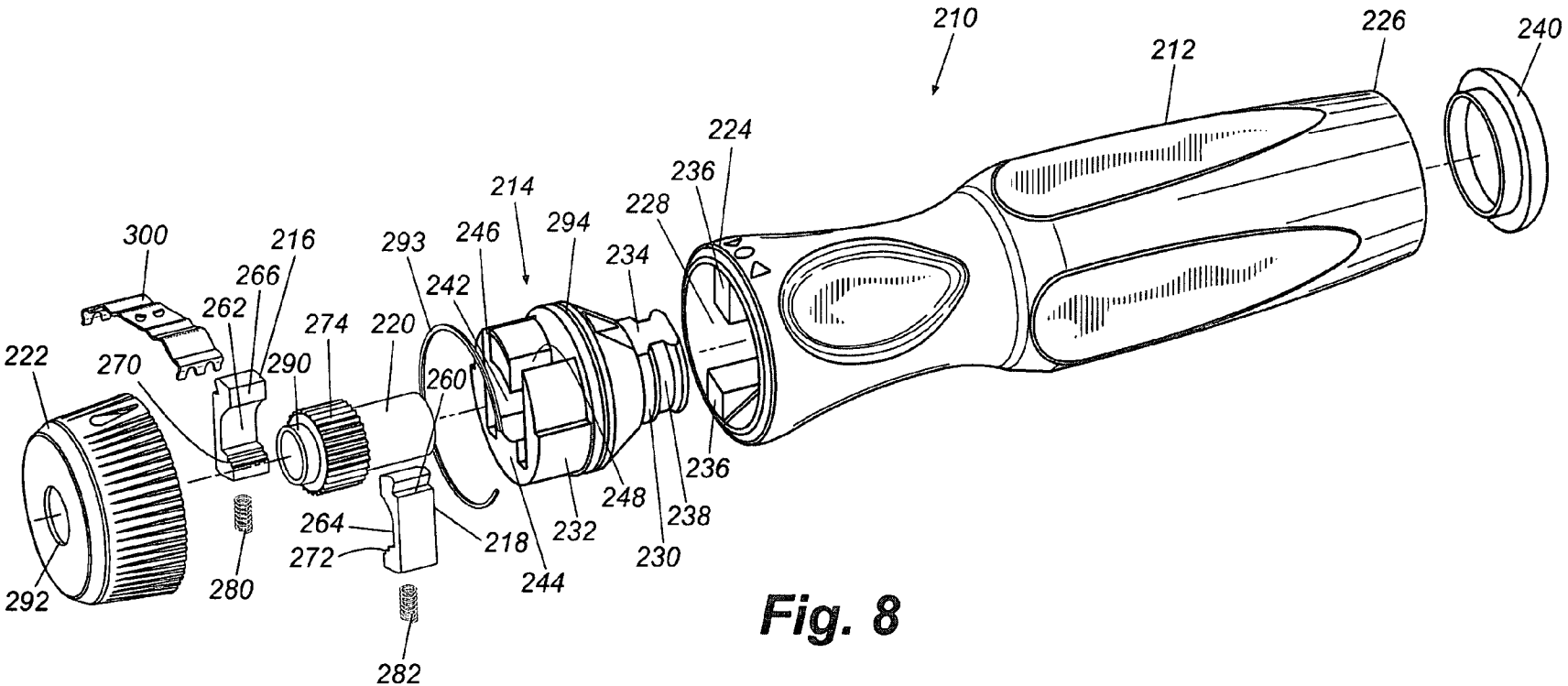
FIG. 8 is an exploded perspective view of the ratcheting tool if FIG. 7.
Figure 9:
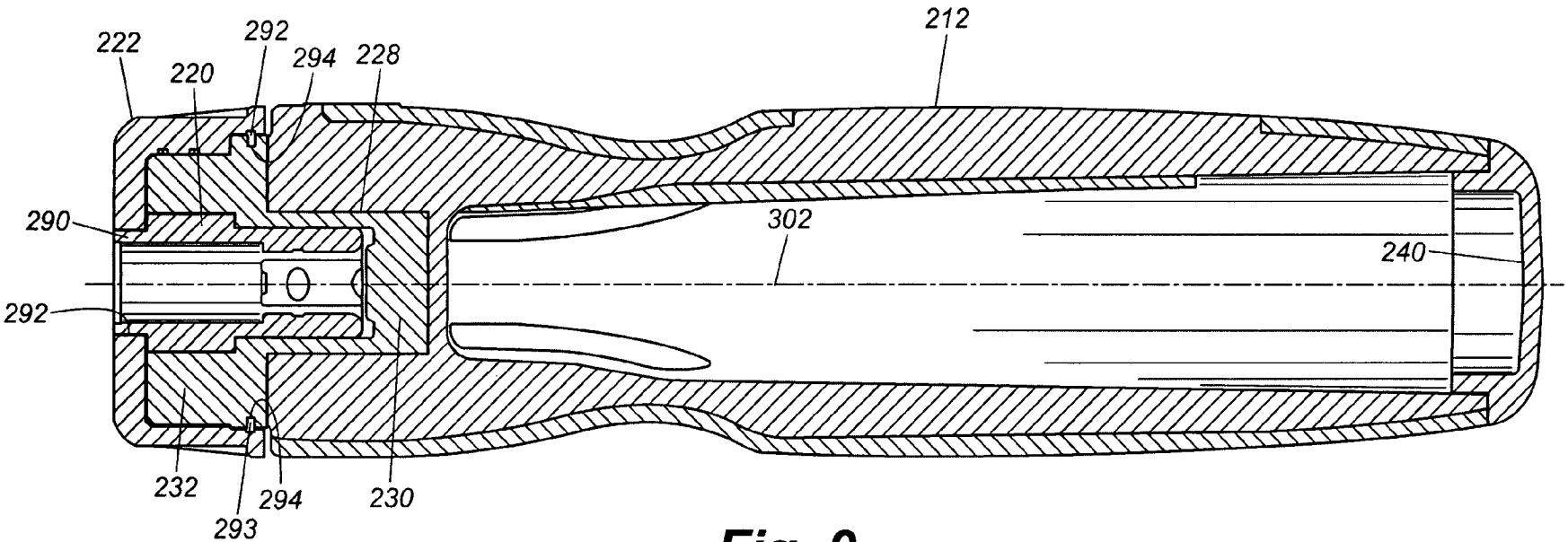
FIG. 9 is a cut away view of the ratcheting tool of FIG. 7.
Figure 12:
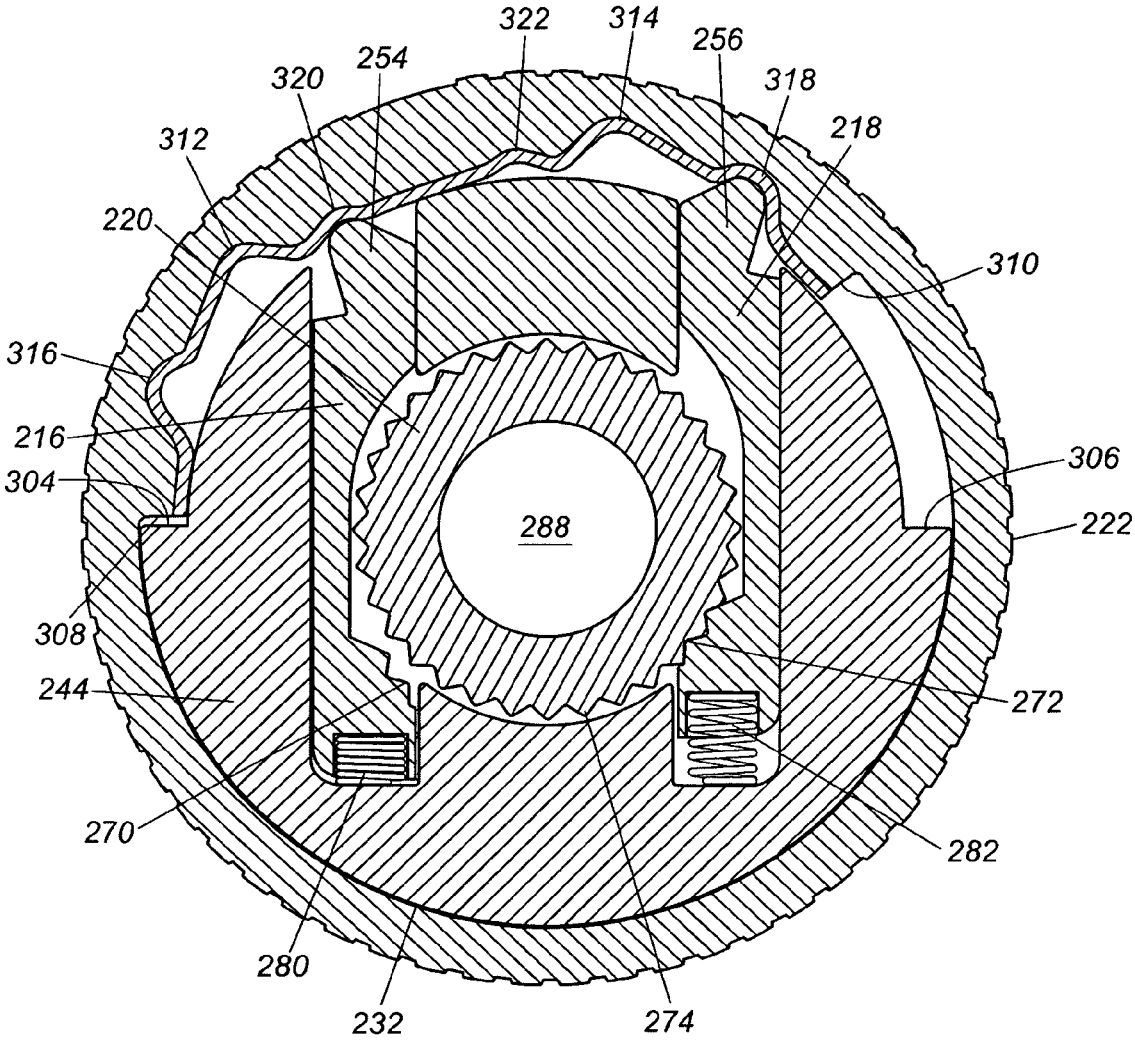
FIG. 12 is a cut away view of the ratcheting tool of FIG. 7 with the cover shown in a third position.

FIGS. 7 and 12 illustrate another embodiment of a ratcheting driver 210 of the present invention. Referring in particular to FIGS. 7, 8 and 9, driver 210 includes a handle 212, a body 214, pawls 216 and 218, a socket ring 220, and a cover 222. Handle 212 is generally cylindrical in shape and includes a first end 224 and a second end 226. First end 224 defines an axial bore 228 formed therein of a size and shape to receive body 214. The exterior shape of handle 212 may vary as desired, and the handle may be formed from any suitable material including, but not limited to, wood, metal or metal alloy, ceramic, rubber or a polymer. Handle 212 may be knurled and/or may include a polymer or rubber coating around its periphery to increase the effectiveness of a user's grasp.

Body 214 comprises a cylindrical shank portion 230 and a ratcheting body 232. Shank portion 230 may contain one or more flat portions 234 that are received between respective corresponding radial ribs 236 to thereby rotationally lock handle 212 to body 214. Other methods may be implemented to rotationally lock handle 212 to shank portion 230. For example, body 214 may be press fit into handle 212, or shank portion 230 may contain ribs or splines (not shown) that mate with corresponding ribs or splines formed on the inner diameter of bore 228 to thereby rotationally lock handle 212 to shank 230. Handle 212 may be axially locked to body 214 through frictional force, adhesive, or as shown in FIG. 8, by a flange (not shown) formed on the inner diameter of handle bore 228 and a recess 238 formed in shank portion 230. A cap 240 is press-fitted in handle end 226 to close off the end of the handle.

Figure 10:
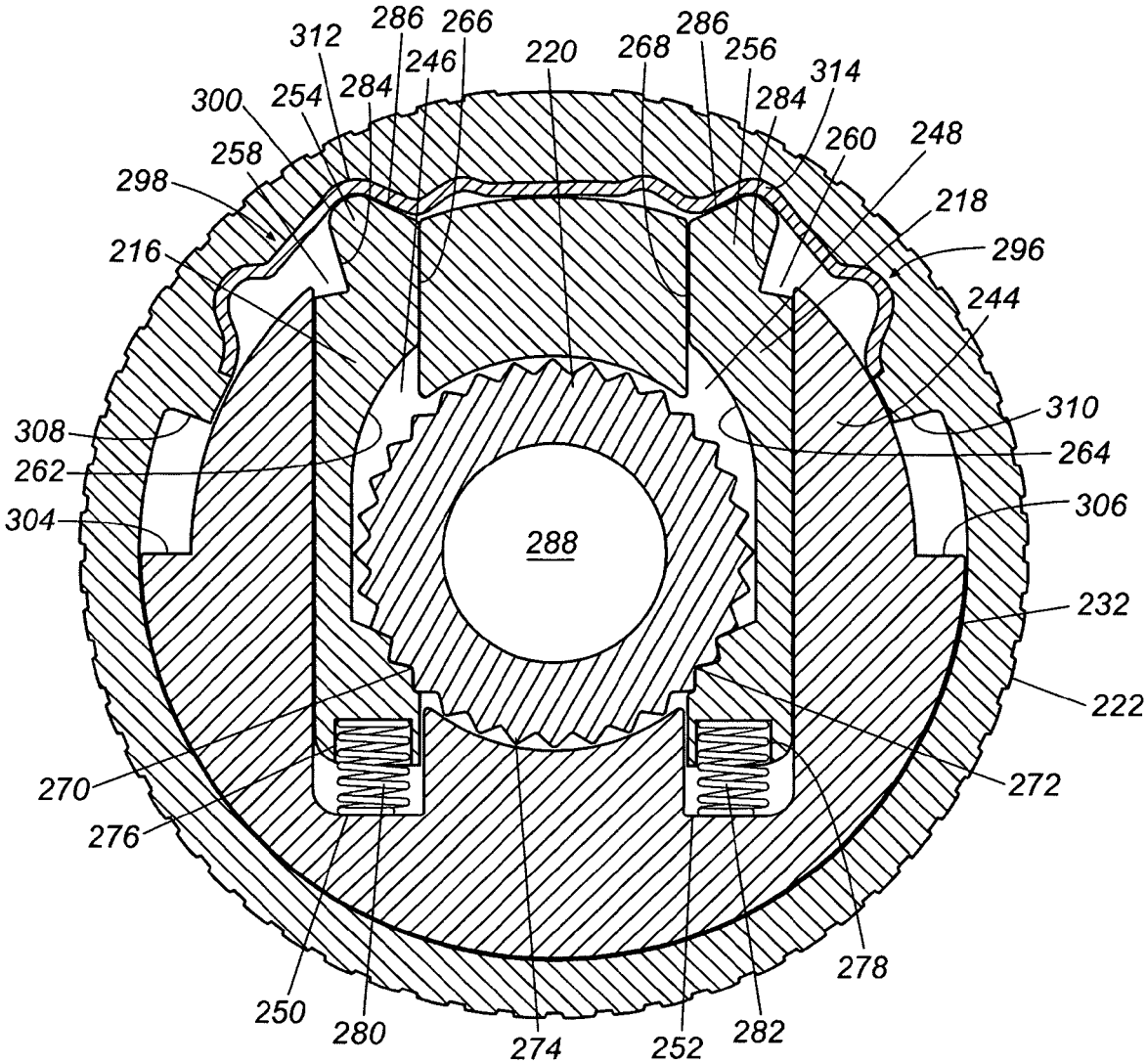
FIG. 10 is a cut away view of the ratcheting tool of FIG. 7 with the cover shown in a first position.

Ratcheting body 232 may be formed from any suitable material such as stainless steel, alloys or other metals polymers or ceramics and, in a preferred embodiment, is formed from zinc alloy. Ratcheting body 232 defines an axial bore 242 formed therein and adapted to receive socket ring 220. A front face 244 defines two recessed chambers 246 and 248 that are recessed from and open into ratchet body front face 244 and receive pawls 216 and 218, respectively (FIG. 10). Because the chambers open into the front face, pawls 216 and 218 may be placed during the driver's manufacture through the open front face 244. Chambers 246 and 248 are closed at one transverse end 250 and 252 but open at the other (FIG. 10). Chambers 246 and 248 are generally rectangular in shape but may also be formed in other shapes corresponding to the shape of pawls 216 and 218.

Referring to FIG. 10, pawls 216 and 218 are generally rectangular but may be formed in any suitable shape. Pawl ends 254 and 256 form notches 258 and 260, and arches 262 and 264 formed on the pawls' inner sides 266 and 268 have first ends that define respective sets of teeth 270 and 272 that correspond in shape and size to teeth 274 formed on the outer periphery of socket ring 220. Teeth 270 and 272 are defined on an arc having a radius that corresponds to the radius of the socket ring 220 so that the teeth on the pawls fit snugly with the teeth on the socket ring. It should be understood that the teeth on the pawl may instead be formed over an arc having a radius that is slightly larger than the radius of the socket ring teeth.

Blind bores 276 and 278 formed in pawls 216 and 218, respectively, receive springs 280 and 282 that bias pawls 216 and 218 in the outward direction from recesses 246 and 248 so that pawl teeth 270 and 272 are biased toward socket ring teeth 274. Each of notches 258 and 260 defines a stopper face 284 and a slider face 286. Stopper face 284 and slider face 286 engage cover 222 during the operation of driver 210, as explained in detail below.

Referring to FIGS. 8 and 10, socket ring 220 is generally cylindrical in shape with an axial bore 288 (FIG. 10) formed in one end. Axial bore 288 may be polygonal in cross-section to receive a polygonal-shaped tool shaft. It should be understood that axial bore 288 may be configured in any suitable shape, for example in an oval, square, rectangular, circle or TORX cross-section, to receive and rotationally lock a suitable tool shaft to socket ring 220. Socket ring teeth 274 are shaped to match pawl teeth 270 and 272. An annular end portion 290 extends through a hole 292 in cover 222 when cover 222 is secured to the ratchet body 232 by a snap ring 293 received in a groove 294 formed in ratchet body 232 (FIGS. 8 and 9).

The number of teeth on socket ring 220 may increase or decrease depending on the desired rotational resolution and torque loading requirements. That is, a larger number of teeth on the socket ring and pawl results in higher rotational resolution. Torque loading, however, is lowered in that the increased number of teeth results in smaller teeth that are more susceptible to slippage or shearing. The opposite is true for a lower number of teeth. That is, when the number of teeth is reduced and tooth size is increased, torque loading increases since the pawl teeth are less likely to slip over the socket ring teeth. However, larger teeth result in lower resolution. Therefore, the driver's use will determine the proper balance between rotational resolution and torque loading and, in turn, the number of teeth and tooth size. Tooth size, shape and density are uniform on both the socket ring and the pawls so that the pawl teeth mesh with the socket ring teeth.

Referring to FIG. 10, cover 222 is generally cylindrical in shape and includes two recessed areas 296 and 298 that are mirror images of each other and that receive a metal clip 300. Clip 300 snugly fits into the recesses and is shaped to match the contour of the recessed areas. Thus, depending on the cover's rotational position with respect to the ratchet body, the recessed areas respectively engage pawl ends 254 and 256. That is, when pawl ends 254 and/or 256 move through its respective recessed areas, springs 280 and 282 can bias the pawls so that pawl teeth 270 and/or 272 engage socket ring teeth 274. Through-hole 292 in cover 222 (FIG. 9), centered about a longitudinal axis 302 (FIG. 9), receives axial extending portion 290 of socket ring 220 (FIG. 9). Ratchet body 232 also has two stop faces 304 and 306 (FIG. 10) that engage stops 308 and 310 formed in cover 222 to prevent the cover from over rotating with respect to ratchet body 232.

In operation, driver 210 applies torque to a tool shaft when a user turns handle 212 in a first direction and/or an opposite second direction. Driver 210 may also ratchet with respect to the tool shaft in either direction, depending on the position of cover 222 with respect to ratchet body 232. FIG. 10 shows cover 222 positioned so that ramped cavities 312 and 314 align with and receive pawl ends 254 and 256, respectively. In this position, springs 280 and 282 bias pawls 216 and 218 upward so that pawl end 254 and 256 are received in cavities 312 and 314. The spring bias causes sliding portions 286 to engage with metal clip 300. Thus, when a user applies torque to handle 212 in the clockwise direction (with respect to FIG. 10) while the socket ring is rotationally fixed to a workpiece, socket ring teeth 274 apply a counterclockwise reaction force to pawl teeth 272. This wedges pawl 218 between the socket ring and the back surface of pawl chamber 248, and torque is thereby applied to the workpiece in the clockwise direction from body 214 through the pawl and the socket ring. The same holds true when the handle is turned in the counterclockwise direction while the socket ring is rotationally fixed to a workpiece. That is, the socket ring teeth 274 apply a clockwise reaction force to pawl teeth 272 causing pawl 216 to wedge between the socket ring and the back surface of pawl chamber 246, and torque is thereby applied to the workpiece in the counterclockwise direction.

Figure 11:
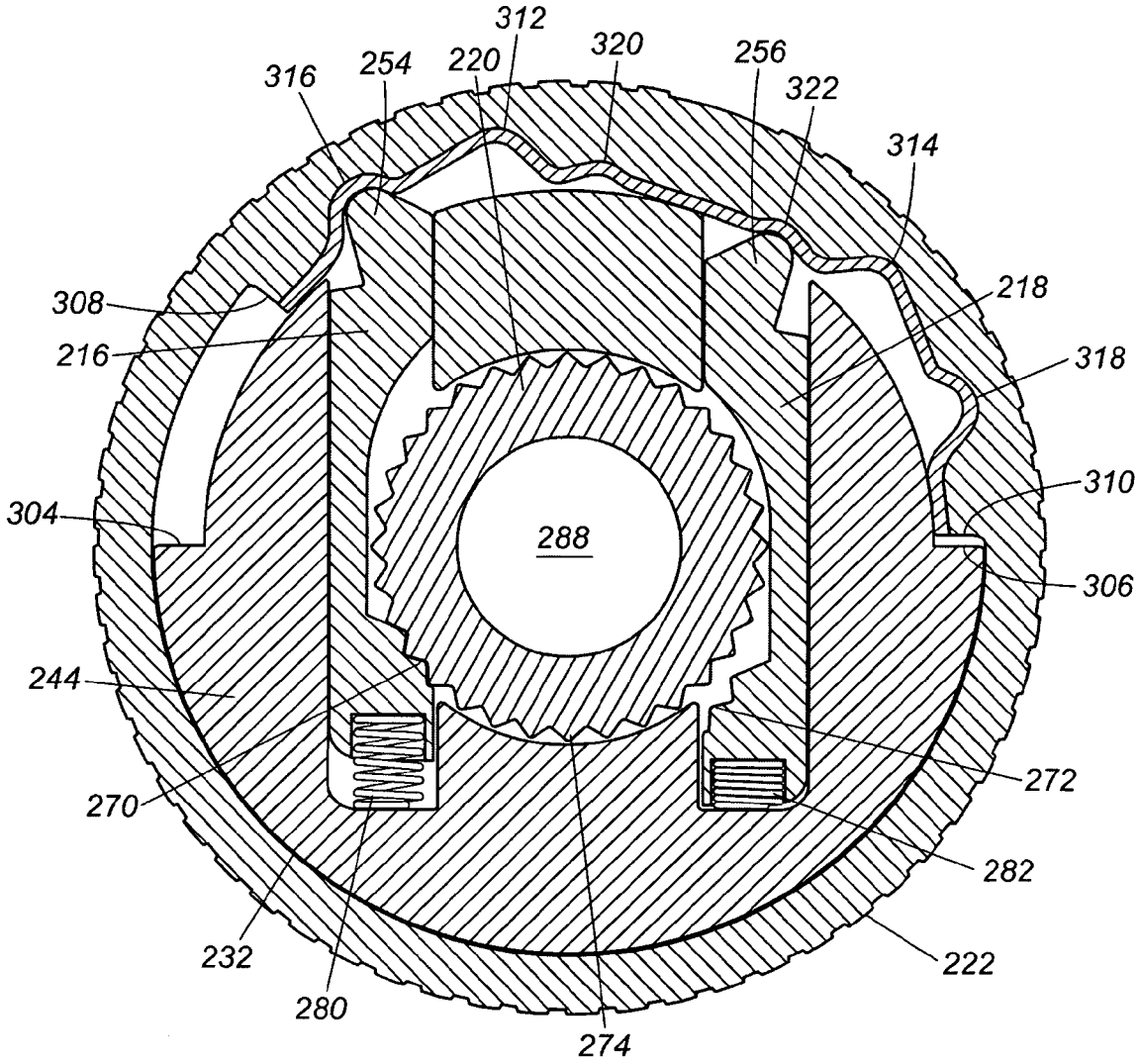
FIG. 11 is a cut away view of the ratcheting tool of FIG. 7 with the cover shown in a second position.

Referring to FIG. 11, cover 222 is shown positioned such that ramped cavity 316 receives pawl end 254 and ramped cavity 322 cams pawl end 256 downward. That is, because ramped cavity 316 receives pawl end 254, spring 280 biases pawl 216 upward such that pawl teeth 270 engage socket ring teeth 274. Likewise, because ramped cavity 322 cams pawl end 256 downward against the upward bias of spring 282, pawl teeth 272 disengage from socket ring teeth 274. As a result, when a user applies torque to handle 212 in the counterclockwise direction (from the perspective shown in FIG. 11) while the socket ring is rotationally fixed to a work piece, socket ring teeth 274 apply a clockwise reaction force to pawl teeth 270 thereby wedging pawl 216 between the socket ring and the back surface of pawl chamber 246. As a result, torque is thereby applied to the work piece in the counterclockwise direction from handle 212 through the ratchet body, the pawl and the socket ring.

If, however, the user rotates handle 212 in the clockwise direction when socket ring 220 is rotationally fixed to the work piece, the reaction force causes pawl 216 to push against the bias of spring 280. This compresses spring 280, and pawl teeth 270 eventually ride over socket ring teeth 274. Spring 280 then pushes pawl 216 upward, forcing pawl teeth 270 back into the next set of socket ring teeth. The ratcheting process repeats as the operator continues to rotate handle 212 in the clockwise direction.

Referring to FIG. 12, cover 222 is shown rotated counterclockwise to a predetermined position where pawl end 254 is received in ramped cavity 320 and pawl end 256 is received in ramped cavity 318. That is, because ramped cavity 320 receives pawl end 254, the walls of ramped cavity 320 bias pawl 216 downward such that pawl teeth 270 disengage from socket ring teeth 274. Contrary to pawl 216, because ramped cavity 322 allows pawl end 256 to move upward from the bias of spring 282, pawl teeth 272 engage socket ring teeth 274. As a result, when a user applies torque to handle 212 in the clockwise direction (from the perspective shown in FIG. 12) while the socket ring is rotationally fixed to a work piece, socket ring teeth 274 apply a counterclockwise reaction force to pawl teeth 272 thereby wedging pawl 218 between the socket ring and the back surface of pawl chamber 248. As a result, torque is thereby applied to the work piece in the clockwise direction from handle 212 through the ratchet body, the pawl and the socket ring.

If, however, the user rotates handle 212 in the counterclockwise direction when socket ring 220 is rotationally fixed to the work piece, the reaction force causes pawl 218 to push against the bias of spring 282. This compresses spring 282, and pawl teeth 272 eventually ride over socket ring teeth 274. Spring 282 then pushes pawl 218 upward, forcing pawl teeth 272 back into the next set of socket ring teeth. The ratcheting process repeats as the operator continues to rotate handle 212 in the counterclockwise direction.

Cover 222 is retained in each rotational position by the reaction forces exerted by the springs between the pawl ends and the ramped cavities. That is, the geometry of the ramped cavities 312, 314, 316, 318, 320 and 322 determines the amount of rotational torque necessary to move cover 222 with respect to ratcheting body 232. The steeper the ramped cavities the higher the torque necessary to rotate the cover. Additionally, the amount of torque may also be affected by the spring rate of springs 280 and 282. The higher the rate, the greater the torque necessary to move the cover relative to the ratcheting body.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the scope and spirit thereof.

What is claimed is:

1. A ratcheting tool driver, said ratcheting tool driver comprising:

a. a hand-actuatable body comprising
  a first axial bore,
  an end face transverse to said first axial bore, and
  a first chamber recessed from and opening into said end face and said first axial bore;
  a second chamber recessed from and opening into said end face and said first axial bore, said second chamber being located on an opposite side of said first axial bore from said first chamber, b. a socket ring disposed in, and rotatable about an axis of, said first axial bore, said socket ring defining socket ring teeth about an outer circumference thereof and defining a second axial bore that receives a tool shank in rotational driving engagement therein;

c. a first pawl having at least one pawl tooth, wherein said first pawl is disposed in said first chamber so that said first pawl is slidable transversely to said first axial bore between
  a first pawl first position in which said at least one first pawl tooth engages said socket ring teeth so that said first pawl blocks relative rotation between said body and said socket ring in a first rotational direction, and
  a first pawl second position in which said at least one first pawl tooth is disengaged from said socket ring teeth, d. a second pawl having at least one pawl tooth, wherein said second pawl is disposed in said second chamber so that said second pawl is slidable transversely to said first axial bore between
  a second pawl first position in which said at least one second pawl tooth engages said socket ring teeth so that said second pawl blocks relative rotation between said body and said socket ring in a second rotational direction opposite said first rotational direction, and a second pawl second position in which said at least one second pawl tooth is disengaged from said socket ring teeth, and e. a cover rotatably received on said hand-actuatable body, said cover comprising an end wall defining a bore therethrough, a generally cylindrical side wall coupled to said end wall, an inner circumference of said side wall defining a first ramped cam area and a second ramped cam area, said first and second ramped cam areas defining a plurality of cavities therein such that an end of said first and said second pawls engage said respective ramped first and second cam areas.

2. The tool driver as in claim 1, wherein said first chamber and said second chamber are elongated and parallel to each other.

3. The tool driver as in claim 1, further comprising a metal clip received in said first and second cam areas, said metal clip shaped to abut the walls of said plurality of cavities therein such that an end of said first and said second pawls engage said metal clip within respective ramped first and second cam areas.

4. The tool driver as in claim 1, wherein said cover is disposed on said body so that said cover is rotatable about said body between a. a first position in which said first cam area engages said first pawl so that said first pawl is in said first pawl first position, and said second cam area engages said second pawl so that said second pawl is in said second pawl first position;

b. a second position in which said first cam area engages said first pawl so that said first pawl is in said first pawl first position, and said second cam area engages said second pawl so that said second pawl is in said second pawl second position; and c. a third position in which said first cam area engages said first pawl so that said first pawl is in said first pawl second position, and said second cam area engages said second pawl so that said second pawl is in said second pawl first position.

5. The tool driver as in claim 4, wherein said first and said second cam areas rotationally secure said cover in one of said first, second and third positions.

6. A ratcheting tool driver, said ratcheting tool driver comprising:

a. a hand-actuatable body comprising a first axial bore, an end face transverse to said first axial bore, and a first chamber recessed from and opening into said end face and said first axial bore;

a second chamber recessed from and opening into said end face and said first axial bore, said second chamber being located on an opposite side of said first axial bore from said first chamber, b. a socket ring disposed in, and rotatable about an axis of, said first axial bore, said socket ring defining socket ring teeth about an outer circumference thereof and defining a second axial bore that receives a tool shank in rotational driving engagement therein;

c. a first pawl having at least one pawl tooth, wherein said first pawl is disposed in said first chamber so that said first pawl is slidable transversely to said first axial bore;

d. a second pawl having at least one pawl tooth, wherein said second pawl is disposed in said second chamber so that said second pawl is slidable transversely to said first axial bore between; and e. a cover rotatably received on said hand-actuatable body, said cover comprising an end wall defining a bore therethrough, a generally cylindrical side wall coupled to said end wall, an inner circumference of said side wall defining a first ramped cam area and a second ramped cam area, said first and second ramped cam areas defining a plurality of cavities therein, and a metal clip received in said first and second cam areas, said metal clip shaped to abut the walls of said plurality of cavities therein such that an end of said first and said second pawls engage said metal clip within respective ramped first and second cam areas.

7. The tool driver as in claim 6, further comprising:

a. a first spring disposed between a wall of said first recessed chamber and said first pawl so that said first spring biases said first pawl at least one pawl tooth towards said socket ring teeth; and b. a second spring disposed between a wall of said second recessed chamber and said second pawl so that said second spring biases said second pawl at least one pawl tooth towards said socket ring teeth.

8. The tool driver as in claim 7, wherein said cover is disposed on said body so that said cover is rotatable about said body between a. a first position in which said first cam area engages said first pawl so that said first pawl at least one tooth engages said socket ring teeth, and said second cam area engages said second pawl so that said second pawl at least one tooth engages said socket ring teeth;

b. a second position in which said first cam area engages said first pawl so that said first pawl at least one tooth engages said socket ring teeth, and said second cam area engages said second pawl so that said second pawl at least one tooth disengages from said socket ring teeth; and c. a third position in which said first cam area engages said first pawl so that said first pawl at least one tooth disengages from said socket ring teeth, and said second cam area engages said second pawl so that said second pawl at least one tooth engages said socket ring teeth.

9. The tool driver as in claim 6, further comprising:

a. a first annular groove formed in an outer circumference of said body;

b. a second annular groove formed in said cover side wall inner circumference; and c. a snap ring received in said first and said second annular grooves when said grooves align with each other.

10. A ratcheting tool driver, said ratcheting tool driver comprising:

a. a hand-actuatable body comprising a first axial bore, an end face transverse to said first axial bore, and a first chamber recessed from and opening into said end face and said first axial bore;

a second chamber recessed from and opening into said end face and said first axial bore, said second chamber being located on an opposite side of said first axial bore from said first chamber, b. a handle axially and rotatably fixed to said body;

c. a socket ring disposed in, and rotatable about an axis of, said first axial bore, said socket ring defining socket ring teeth about an outer circumference thereof and defining a second axial bore that receives a tool shank in rotational driving engagement therein;

d. a first pawl having at least one pawl tooth, wherein said first pawl is disposed in said first chamber so that said first pawl is slidable transversely to said first axial bore between a first pawl first position in which said at least one first pawl tooth engages said socket ring teeth so that said first pawl blocks relative rotation between said body and said socket ring in a first rotational direction, and a first pawl second position in which said at least one first pawl tooth is disengaged from said socket ring teeth, wherein said first pawl is biased toward said first pawl first position;

e. a second pawl having at least one pawl tooth, wherein said second pawl is disposed in said second chamber so that said second pawl is slidable transversely to said first axial bore between a second pawl first position in which said at least one second pawl tooth engages said socket ring teeth so that said second pawl blocks relative rotation between said body and said socket ring in a second rotational direction opposite said first rotational direction, and a second pawl second position in which said at least one second pawl tooth is disengaged from said socket ring teeth, wherein said second pawl is biased toward said second pawl first position f. a cover rotatably received on said hand-actuatable body, said cover comprising an end wall defining a bore therethrough, a generally cylindrical side wall coupled to said end wall, an inner circumference of said side wall defining a first ramped cam area and a second ramped cam area, said first and second ramped cam areas defining a plurality of cavities therein, and g. a metal clip received in said first and second cam areas, said metal clip shaped to abut the walls of said plurality of cavities therein such that an end of said first and said second pawls engage said metal clip within respective ramped first and second cam areas.

11. The tool driver as in claim 10, further comprising:

a. a first spring disposed between a wall of said first recessed chamber and said first pawl so that said first spring biases said first pawl toward said first pawl first position; and b. a second spring disposed between a wall of said second recessed chamber and said second pawl so that said second spring biases said second pawl toward said second pawl first position.

12. The tool driver as in claim 10, wherein said cover is selectively movable with respect to said hand-actuatable body into a first position in which said first cam area engages said first pawl so that said first pawl is in said first pawl second position and said second cam area releases said second pawl into said second pawl first position, and a second position in which said second cam area engages said second pawl so that said second pawl is in said second pawl second position and said first cam area releases said first pawl into said first pawl first position.

13. The tool driver as in claim 12, wherein said first and said second cam areas retain said cover respectively in said first cam position and said second cam position.

* * * * *